US008690393B2

(12) United States Patent
Lee et al.

(10) Patent No.: US 8,690,393 B2
(45) Date of Patent: Apr. 8, 2014

(54) LED LIGHTING FIXTURE

(75) Inventors: Ke-Chin Lee, Zhongshan (CN); Hung-Chieh Chen, Zhongshan (CN)

(73) Assignee: Zhongshan Weiqiang Technology Co., Ltd., Zhongshan (CN)

( * ) Notice: Subject to any disclaimer, the term of this patent is extended or adjusted under 35 U.S.C. 154(b) by 24 days.

(21) Appl. No.: 13/544,017

(22) Filed: Jul. 9, 2012

(65) Prior Publication Data

US 2013/0039057 A1 Feb. 14, 2013

(30) Foreign Application Priority Data

Aug. 9, 2011 (CN) ..... 2011 1 0227015

(51) Int. Cl.
*F21V 29/00* (2006.01)

(52) U.S. Cl.
USPC ..... 362/294; 362/267; 362/373

(58) Field of Classification Search
USPC ..... 362/267, 294, 373, 235, 345
See application file for complete search history.

(56) References Cited

U.S. PATENT DOCUMENTS 7,011,431 B2 * 3/2006 Ono et al. ..... 362/241
7,431,475 B2 * 10/2008 Hafuka et al. ..... 362/218
7,461,952 B2 * 12/2008 Trenchardl et al. ..... 362/294
7,494,249 B2 * 2/2009 Li ..... 362/294
7,762,696 B2 * 7/2010 Wan et al. ..... 362/373
7,847,471 B2 * 12/2010 Liu et al. ..... 313/46
8,053,960 B2 * 11/2011 Liu et al. ..... 313/46
8,092,054 B2 * 1/2012 Liu et al. ..... 362/373
8,294,339 B2 * 10/2012 Lin et al. ..... 313/46
2008/0067954 A1 * 3/2008 Black et al. ..... 315/294
2008/0247177 A1 * 10/2008 Tanaka et al. ..... 362/373
2010/0128482 A1 * 5/2010 Zhou et al. ..... 362/253
2012/0287637 A1 * 11/2012 Mahalingam et al. ... 362/249.02

* cited by examiner

*Primary Examiner* — John A Ward
(74) *Attorney, Agent, or Firm* — Jackson IPG PLLC

(57) ABSTRACT

The invention discloses an LED lighting fixture, which comprises a heat sink, a reflection cup, an LED module, a supporting member, a heat pipe and a vapor chamber, wherein the heat sink is provided with a center hole section and radiating sections; a concave opening is formed at the front end by the surrounding of the radiating section; the reflection cup is arranged at the concave opening; the outside of the reflection cup is surrounded by the heat pipe and makes contact with the radiating section; the LED module is arranged at the bottom of the reflection cup; the supporting member makes contact with the LED module and is arranged at the tail end of the heat pipe; and the vapor chamber is provided with a smoothing section for receiving the LED module and interposing sections for being interposed into the center hole section of the heat sink.

13 Claims, 4 Drawing Sheets

LED LIGHTING FIXTURE

FIELD OF THE INVENTION

The invention relates to a light fixture, in particular to an LED lighting fixture.

BACKGROUND OF THE INVENTION

A reflection cup may be arranged on the front of the traditional LED lighting fixture such as a flush light panel or a projection lamp in order to improve the illumination effect of the LED lighting fixture, so that the irradiation area and the irradiation distance of a light source can be effectively improved and the adjustment and control are also more convenient. Moreover, on account of the characteristic of high heat quantity produced when the LED operates, an LED heat sink may be arranged at the rear of the lighting fixture. In general, the heat dissipation of the heat sink is related to the structure and the dissipation area of the heat sink. The most commonly used heat sink currently adopts a fin-type structure or similar structure. The higher the power of LEDs, the larger the volume of the corresponding heat sink. Furthermore, due to the addition of the reflection cup and corresponding components, the lighting fixture may be too large and possible problems may occur in assembly and application. In addition, as for the LED lighting fixture, the higher the power, the larger the heat quantity produced when the LED operates, which is undoubtedly a test for the heat sink. In particular, how to achieve better radiating effect with limited volume is related to whether the lighting fixture can be used stably for a long time and the problems such as the adapting of the lighting fixture to various places and environments.

SUMMARY OF THE INVENTION

The invention aims to provide an LED lighting fixture capable of achieving better radiating and illuminating effect on the basis of enough small or appropriate volume, so as to improve the operation stability and prolong the service life and be better adapted to different environments.

In order to solve the technical problems, the invention adopts the technical proposal that:

The invention relates to an LED lighting fixture, which comprises:

a heat sink, in which the heat sink is provided with a center hole section and a plurality of radiating sections arranged around the center hole section; and a concave opening is formed at the front end of the heat sink by the surrounding of the radiating sections;

a reflection cup, in which the reflection cup is arranged at the concave opening of the heat sink; and the outerwall of the reflection cup makes contact with the radiating sections;

an LED module, in which the LED module is formed by a plurality of LEDs welded on a ceramic substrate and arranged at the bottom of the reflection cup;

a supporting member, in which a hollow through hole is formed in the middle of the supporting member and makes contact with the circumference of the substrate of the LED module;

at least one heat pipe, in which a sealed inner cavity is formed inside the heat pipe and provided with a powder sintering section and a working solution subjected to vapor-liquid two-phase variation; and the heat pipe helically surrounds the outerwall of the reflection cup and has a tail end making contact with the supporting member, so that the heat produced when the LED module operates is received by the heat pipe, dispersed by one-dimensional linear means along the length direction of the heat pipe, rapidly conducted to the reflection cup and the radiating sections making contact with the reflection cup, and radiated to the air by the radiating sections; and a vapor chamber, in which a sealed inner cavity is formed inside the vapor chamber and provided with a powder sintering section and a working solution subjected to vapor-liquid two-phase variation; a smoothing section and two interposing sections are formed outside the vapor chamber; the smoothing section is used for receiving the LED module; and the two interposing sections are symmetrically arranged at both ends of the smoothing section by press forming, perpendicular to the smoothing section and interposed and fixed into the center hole section, so that the heat produced when the LED module operates is received by the smoothing section of the vapor chamber, dispersed towards the two interposing sections along the smoothing section by means of two-dimensional surface, rapidly conducted to the heat sink, transferred to the radiating sections from the center hole section, and finally radiated to the air.

Furthermore, an indent for receiving the heat pipe is formed on the outerwall of the reflection cup; and a groove for receiving the tail end of the heat pipe is formed on the supporting member, so as to be conductive to the positioning of the heat pipe.

Furthermore, the substrate used by the LED module is a ceramic substrate.

Furthermore, one side of the heat pipe facing to the heat sink is a plane or a cambered surface formed by pressing; the tail end of the heat pipe makes direct contact with the LED module; and one side of the tail end, making contact with the LED module, is a plane formed by pressing, so that the contact between the heat pipe and the heat sink and the LED module is better, thus the heat transmission is rapider, which is more conductive to rapid heat dissipation.

Furthermore, a through hole is formed in the middle of the supporting member; and the LED module passes through the through hole and makes contact with the smoothing section of the vapor chamber.

Furthermore, the cross section of each interposing section of the vapor chamber takes the shape of a circular arc which is cambered outwards, so that the two interposing sections are integrated into a circular arc with symmetrical notches; correspondingly, the center hole section of the heat sink is provide with circular holes for interposing the two circular interposing sections respectively; transition sections retracted towards the center of a center shaft are arranged between the smoothing section and the two interposing sections of the vapor chamber; and a receiving cavity is formed at the front end of the center hole section of the heat sink and used for receiving and positioning the transition sections of the vapor chamber.

According to a preferred proposal, the radiating sections adopt a fin-type structure formed by a plurality of radiating fins; and the aim of heat dissipation can be achieved by increasing the heat dissipation area of the radiating fins making directly contact with the air.

According to another preferred proposal, a transition edge is connected between two adjacent radiating fins, so that an air channel with the chimney effect is formed between the two adjacent radiating fins, thus the air motion and heat exchange can be strengthened.

According to another preferred proposal, the total radiating power after the vapor chamber is combined with the heat pipe is more than or equal to the thermal power produced by the LED module.

According to another preferred proposal, the heat conduction path of the LED module is as follows: the heat is directly conducted from the LEDs to the ceramic substrate first, then directly conducted to the heat pipe and the vapor chamber, finally conducted to the reflection cup and the heat sink, and dispersed by a fin device of the heat sink via cross-ventilation and radiation, in which both the substrate and the heat pipe are heat conduction media with low thermal resistance.

The invention has the advantages that: due to the reflection cup with reflecting effect of the invention, not only the light efficiency is guaranteed but also the volume of the lighting fixture can be reduced as the reflection cup is embedded into the heat sink. Moreover, in order to guarantee enough heat dissipation, the heat is transferred from the LED module to the heat sink through the heat pipe by one-dimensional linear conduction and the vapor chamber by two-dimensional surface conduction respectively, thus the heat sink and the reflection cup of the lighting fixture are effectively utilized for heat dissipation, consequently the heat dissipation is effectively improved. The radiating mode of the invention is novel. The radiating efficiency of the lighting fixture of the invention is improved by about one time under same volume by experimental verification compared with the prior art, thus the lighting fixture of the invention is superior.

BRIEF DESCRIPTION OF THE DRAWINGS

For clearer description of the technical proposals of the embodiments of the invention, simple description is given to the attached drawings required in the description of the embodiments. Obviously, the attached drawings illustrated are only one part of embodiments of the invention and not all the embodiments. Those skilled in the art may also obtain other design proposals and attached drawings based on the attached drawings without need for creative labor.

DETAILED DESCRIPTION OF THE PREFERRED EMBODIMENTS

Clear and complete description is given to the concept, concrete structure and technical effects generated of the invention with the attached embodiments and drawings, so as for the objectives, characteristics and effects of the invention to be fully understood. Obviously, the embodiments illustrated are only one part of embodiments of the invention and not all the embodiments. Other embodiments obtained by those skilled in the art based on the embodiments of the invention without the need of creative labor are all within the scope of protection of the invention.

Figure 1:
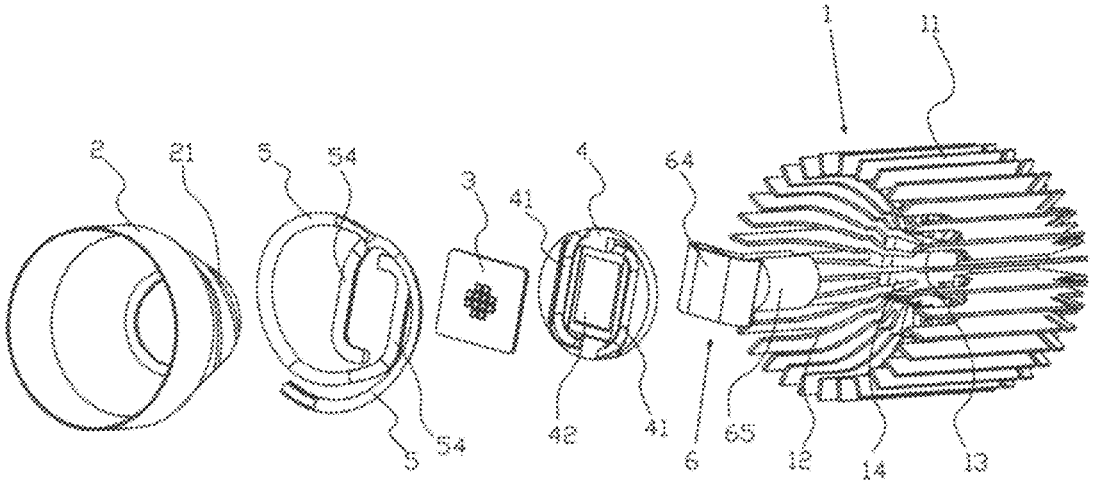
FIG. 1 is an exploded structure diagram of the LED lighting fixture provided by the invention.

As illustrated in FIG. 1, the LED lighting fixture disclosed by the invention comprises a heat sink 1, a reflection cup 2, an LED module 3, a supporting member 4, heat pipes 5 and a vapor chamber 6. The heat sink 1 has the function of providing heat dissipation for the lighting fixture and consists of a center hole section and a plurality of radiating sections 11 arranged around the center hole section, wherein a concave opening 12 is formed at the front end of the heat sink 1 by the surrounding of the radiating sections 11 and takes the shape corresponding to that of the reflection cup 2, so as to be used for receiving the reflection cup 2. Therefore, in shape, it is equivalent that the reflection cup 2 is embedded into the heat sink 1 to form a unified and integrated structure. Compared with the traditional lighting fixture, the reflection cup 2 may not be protruded out of the heat sink 1, so that the volume is reduced. The reflection cup 2 takes the shape of a conical cylinder and is provided with an opening at the front end and the rear end respectively, wherein the rear opening is used for being engaged with the LED module 3 and the front opening is for the light emitted by the LED module 3 to be emitted smoothly. Therefore, in terms of connection relation, the outerwall of the reflection cup 2 makes contact with the radiating sections 11 of the heat sink 1, so that the LED lighting fixture has the effect of heat transmission. The LED module 3 is arranged at the rear opening of the reflection cup 2 and engaged with the reflection cup 2, so that the light is emitted from the front end of the reflection cup 2 during the operation and meanwhile can be reflected by the reflection cup 2, thus the aim of beam collection can be realized.

Figure 2:
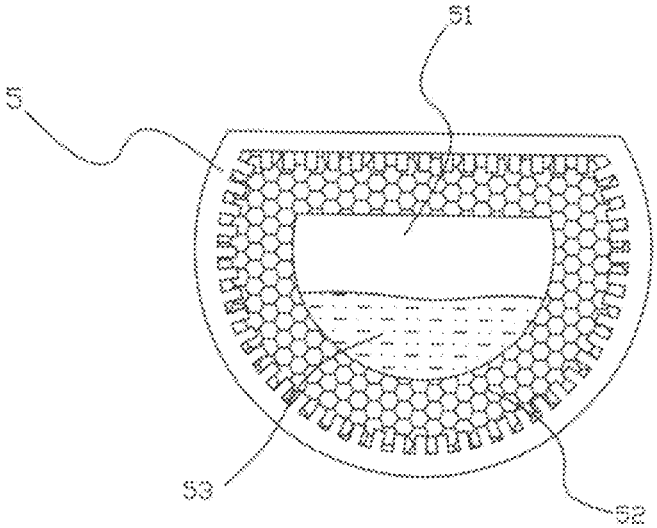
FIG. 2 is a sectional structure diagram of the heat pipe in an embodiment of the invention.

As heat may be produced when the LED module 3 operates, in-time heat dissipation is required. However, compared with the traditional structure, due to the means of embedded assembly of the reflection cup 2 of the invention, the heat dissipation area is correspondingly reduced. For the radiating efficiency to be not affected, the invention adopts two heat dissipation proposals. One proposal is to adopt the heat pipes 5 by means of one-dimensional linear heat conduction. As illustrated in FIG. 2, the heat pipe 5 take the shape of a tubular strip; a sealed inner cavity 51 is formed inside the heat pipe 5; an axially extended slot is formed on the inner wall of the heat pipe 5; and the inner cavity 51 is provided with a powder sintering section 52 and a working solution 53 subjected to vapor-liquid two-phase variation. By utilization of the capillary action, when the heat pipe 5 makes contact with a heat source, namely the LED module 3, the working solution will be evaporated to absorb the heat and flows to a cold end for condensation under the action of pressure difference; the heat is released during the condensation; and the condensed solution returns back to a heat end by a capillary force, thus the aim of rapid heat conduction will be achieved by to-and-fro circulation.

As illustrated in FIG. 1, two heat pipes 5 are adopted in the embodiment and curved into the shape adapted to the rear side of the reflection cup 2, and mutually symmetrically and helically surround the outerwall on the rear side of the reflection cup 2, so that the heat pipes 5 make contact with the reflection cup 2 and adjacent radiating sections 11 and have the function of heat transmission. In addition, a tail end 54 of each heat pipe 5 makes tight contact with the supporting member 4 and the rear side of the substrate of the LED module 3, and a section of the tail end 54 of the heat pipe 5, making contact with the rear side of the substrate of the LED module 3, is smooth. Therefore, the heat produced when the LED module 3 operates may be directly transferred or indirectly transferred to the tail ends 54 of the heat pipes 5 through the supporting member 4, rapidly conducted to the reflection cup 2 and the radiating sections 11 through the heat pipes 5, and dispersed by the radiating sections 11 and the reflection cup 2.

Figure 3:
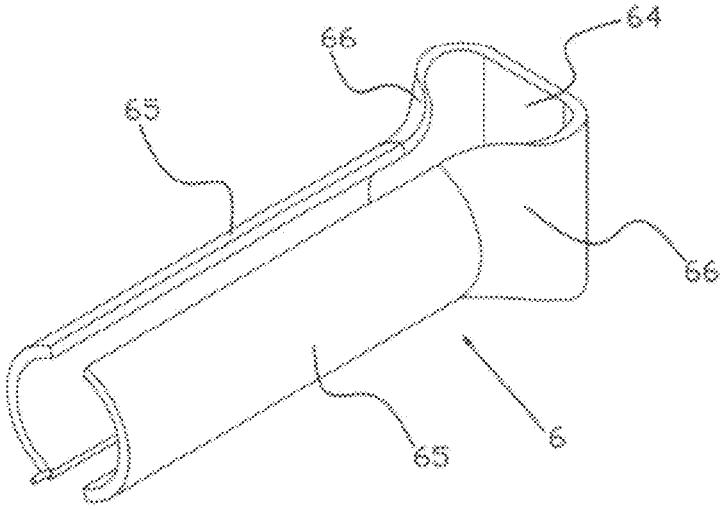
FIG. 3 is a structure diagram of the vapor chamber in the embodiment of the invention.
Figure 4:
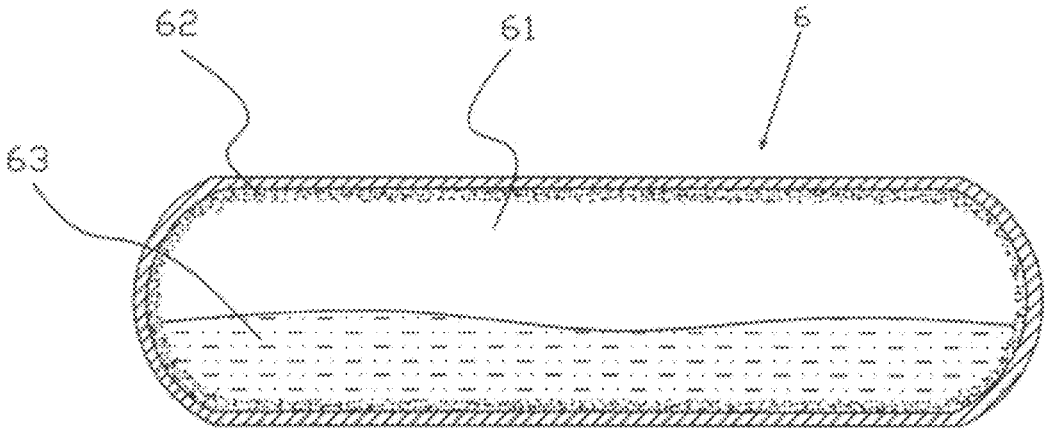
FIG. 4 is an inner structure diagram of the vapor chamber in the embodiment of the invention.

Moreover, when the heat dissipation proposal of the heat pipes 5 is adopted, the vapor chamber 6 also provides another heat dissipation path. As illustrated in FIG. 3, a sealed inner cavity 61 is also formed inside the vapor chamber 6 and provided with a powder sintering section 62 and a working solution 63 subjected to vapor-liquid two-phase variation. The operating principle of the vapor chamber 6 is the same with that of the heat pipes. In shape, the vapor chamber 6 of the invention is subjected to pressing treatment to form a smoothing section 64 and two interposing sections 65, wherein the two interposing sections are symmetrically arranged at both ends of the smoothing section 64 and extended afterwards; and the smoothing section 64 makes tight contact with the rear side of the substrate of the LED module 3, so that the heat produced when the LED module 3 operates is rapidly absorbed by the smoothing section 64 and dispersed to the interposing sections 65 with the smoothing section 64 as the center by means of two-dimensional surface. The interposing sections 65 are interposed and fixed into the center hole section of the heat sink 1, so as to make contact with the sidewall of the center hole section, thus the heat transferred to the interposing sections 65 will be transferred to the heat sink 1 through a contact section and then dispersed by the radiating sections 11 of the heat sink 1.

Figure 5:
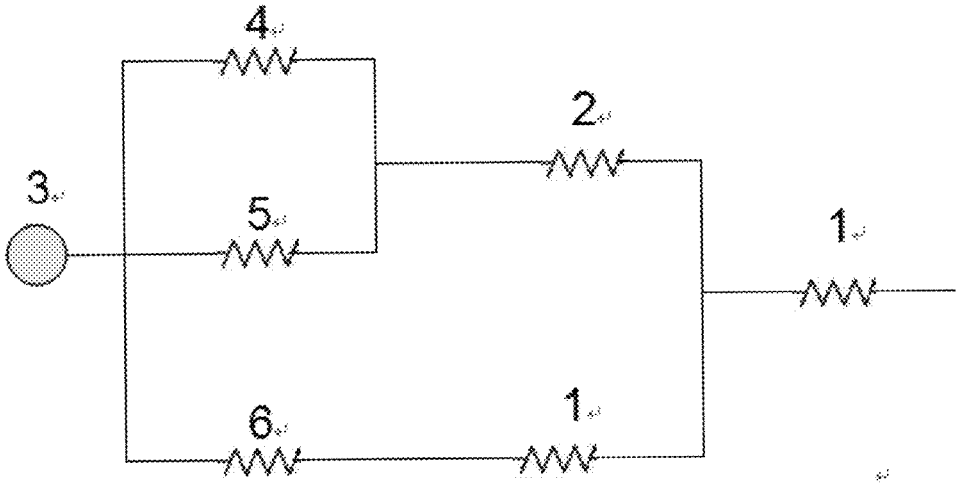
FIG. 5 is an equivalent thermoresistance heat dissipation path diagram of the LED lighting fixture provided by the invention.

It can be seen from the above proposal that the LED lighting fixture has two heat dissipation channels in parallel to each other. One path mainly takes the heat pipes 5 as a heat conduction body: LED module 3—heat pipe 5 (supporting member 4)—reflection cup 2/heat sink 1. The other path takes the vapor chamber 6 as the heat conduction body: LED module 3—vapor chamber 6—heat sink 1. The principle thereof is as illustrated in FIG. 5. Wherein, the heat sink 1 bears most of the radiating effect, which is about 80 percent, and the reflection cup 2 bears about 20 percent of the radiating effect. It can be seen that the radiating mode of effective utilization of the heat dissipation path of the heat sink 1 and the reflection cup 2 in the proposal of the method is innovative.

As the basic structures of the heat pipes 5 are circular pipes and the heat pipes 5 are arranged by directly surrounding the outerwall on the rear side of the reflection cup 2, the fixation of the heat pipes 5 is inconvenient. Therefore, as a preferred proposal, indents 21 can be formed on the outerwall on the rear side of the reflection cup 2 and used for receiving and positioning the heat pipes 5 respectively. In addition, as illustrated in FIG. 2, one sides of the heat pipes 5, making contact with the radiating sections 11, can be pressed to form planes or cambered surfaces as much as possible, so as to be completely adhered to the radiating sections 11, thus the contact area is larger and the heat conduction effect is better.

Figure 6:
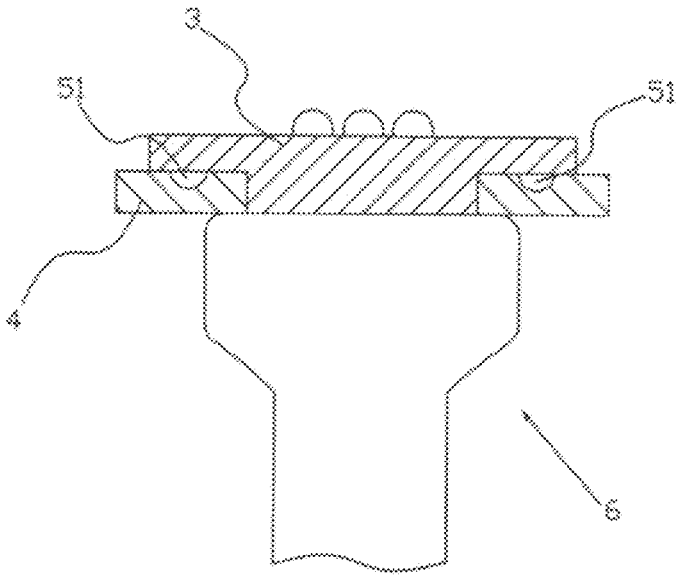
FIG. 6 is a schematic diagram illustrating a fixed structure of the heat pipe, the LED module, the supporting member and the vapor chamber in the LED lighting fixture provided by the invention.

The supporting member 4 is taken as a component for intermediate connection and auxiliary fixation. For the convenience of fixing the heat pipes 5, grooves 41 for receiving the tail ends 54 of the heat pipes 5 can be formed on the surface of the supporting member 4. The tail ends 54 of the heat pipes 5 can make direct contact with the rear side of the substrate of the LED module 3 and can also make indirect contact through an intermediate connecting piece, namely the supporting member 4. Of course, the heat conduction efficiency in the case of direct contact may be higher. Therefore, as a preferred proposal, the grooves 41 can be formed on the surface of the supporting member 4, which is used for placing the rear side of the substrate of the LED module 3. After the assembly, the tail ends 54 of the heat pipes 5 are pressed into the groove 41 through the LED module 3, and meanwhile the tail ends 54 of the heat pipes 5 make direct contact with the LED module 3. In order to achieve larger contact area and better heat conduction effect, one sides of the tail ends 54, making contact with the LED module, can also be pressed into planes, so as to realize the plane-plane contact and adherence, with the state thereof as illustrated in FIG. 6.

Best heat conduction efficiency can only be achieved when the rear side of the substrate of the LED module 3 makes contact with the smoothing section 64 of the vapor chamber 6. Therefore, as a preferred proposal, a through hole 42 can be formed in the middle of the supporting member 4, and the bottom of the LED module 3 passes through the through hole 42 and makes contact with the smoothing section 64. One reference structure is as illustrated in FIG. 6. Therefore, a section of the bottom of the LED module 3, adhering to the front side of the supporting member 4 and pressing the tail ends 54, may not be affected. Meanwhile, the LED module 3 and the supporting member 4 are mutually fixed better, thus the structure stability and best heat conduction efficiency can be guaranteed.

The vapor chamber 6 is directly interposed and fixed into the center hole section of the heat sink 1 through the interposing sections 65. In view of convenient manufacturing and reasonable fixation, the interposing sections 65 can be designed into arcs, and cross sections of the interposing sections 65 take the shape of circular arcs which are cambered outwards, so that the two interposing sections 65 are integrated into a circular arc with symmetrical notches. Correspondingly, corresponding interposing and fixing positions of the center hole section of the heat sink 1 can be designed into circular holes 13 for interposing the two circular interposing sections 65 respectively, and the two circular holes 13 can be communicated with each other, so that a middle section can be taken as a space for the wiring of the LED module 3 and the assembly of additional components and parts. In addition, transition sections 66 retracted towards the center of a center shaft of the vapor chamber 6 can be arranged between the smoothing section 64 and the two interposing sections 65 of the vapor chamber 6. Correspondingly, a receiving cavity 14 is formed at the front end of the center hole section of the heat sink 1 and used for receiving and positioning the transition sections 66, thus the fixing effect can be further improved.

Figure 7:
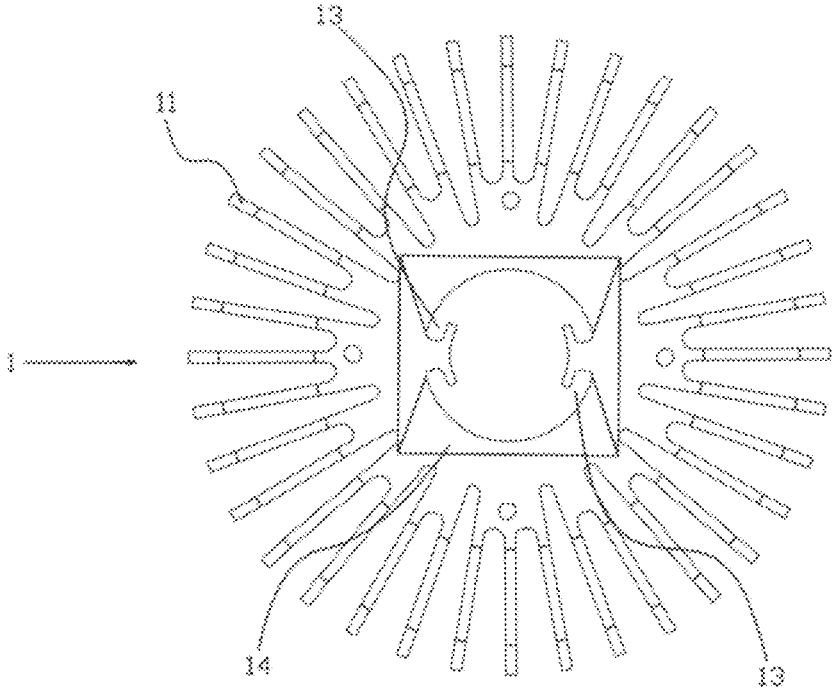
FIG. 7 is a structure diagram of the heat sink in an embodiment of the invention.

In the invention, both the reflection cup 2 and the heat sink 1 have the function of heat dissipation but the heat sink 1 is the main heat dissipation structure. The performances of the heat sink 1 determine the heat dissipation of the whole lighting fixture. In the embodiment as illustrated in FIG. 7, a most common fin-type structure of the heat sink 1 is provided, wherein the heat dissipations 11 are formed by a plurality of radiating fins which are circularly arranged around the center hole section, so that the whole heat sink 1 takes the shape of a circular cylinder. The radiating fins make direct contact with the air. The radiating effect can be achieved by radiating heat to the air. The number and the surface area of the fins determine the heat dissipation.

Figure 8:
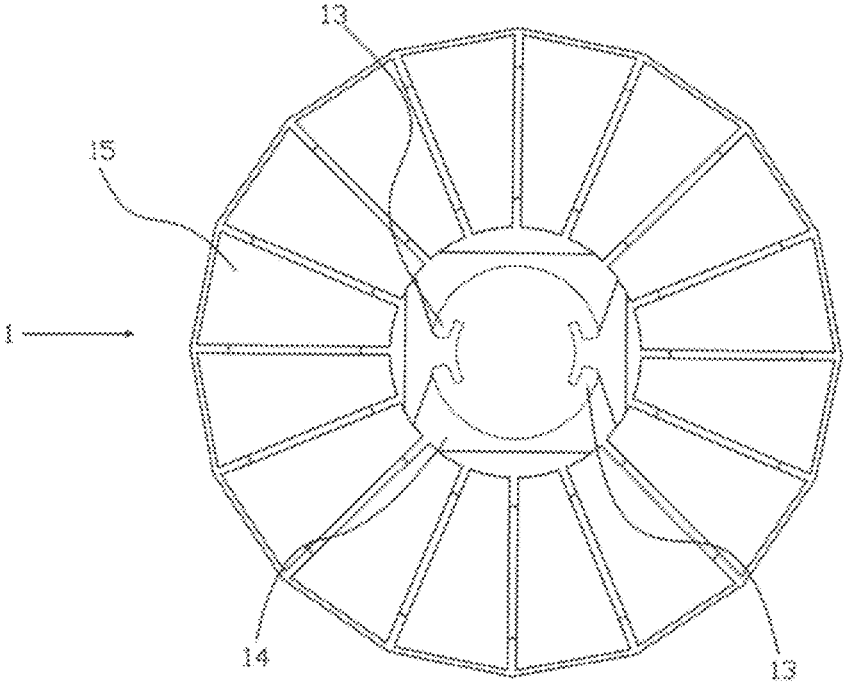
FIG. 8 is a structure diagram of the heat sink in another embodiment of the invention.

FIG. 8 illustrates another relatively typical embodiment of the heat sink 1, wherein transition edges can be connected between adjacent radiating fins, so that an air channel 15 with chimney effect is formed between two adjacent fins. When the heat sink 1 operates, the air channels 15 can accelerate the air motion, so as to accelerate the heat exchange.

It should be noted that the above only illustrates the preferred embodiments of the invention and is not considered as the unique scope of protection of the invention. It should be understood by those skilled in the art that various variations and modifications can be made without departing from the scope of protection of the invention. Therefore, the invention is not limited to the embodiments disclosed but determined by the attached claim language. That is to say, the equivalent variations and modifications made without departing from the scope of the claims of the invention should be still within the scope of the claims of the invention.

What is claimed is:

1. An LED lighting fixture, comprising:

a heat sink, in which the heat sink provided with a center hole section and a plurality of radiating sections arranged around the center hole section; and a concave opening formed at the front end of the heat sink by the surrounding of the radiating sections;

a reflection cup, in which the reflection cup arranged at the concave opening of the heat sink; and the outerwall of the reflection cup making contact with the radiating sections;

an LED module, in which the LED module formed by a plurality of LEDs welded on a ceramic substrate and arranged at the bottom of the reflection cup;

a supporting member, in which a hollow through hole formed in the middle of the supporting member and making contact with the circumference of the substrate of the LED module;

at least one heat pipe, in which a sealed inner cavity formed inside the heat pipe and provided with a powder sintering section and a working solution subjected to vapor-liquid two-phase variation; and the heat pipe helically surrounding the outerwall of the reflection cup and having a tail end making contact with the supporting member, so that the heat produced when the LED module operates is rapidly conducted to the reflection cup and the radiating sections; and a vapor chamber, in which a sealed inner cavity formed inside the vapor chamber and provided with a powder sintering section and a working solution subjected to vapor-liquid two-phase variation; a smoothing section and two interposing sections formed outside the vapor chamber; the smoothing section used for receiving the LED module; and the two interposing sections symmetrically arranged at both ends of the smoothing section by press forming, perpendicular to the smoothing section and interposed and fixed into the center hole section, so that the heat produced when the LED module operates is rapidly conducted to the heat sink; wherein the total radiating power after the vapor chamber is combined with the heat pipe being more than or equal to the thermal power produced by the LED module; and the heat conduction path of the LED module being as follows: the heat directly conducted from the LEDs to the ceramic substrate first, then directly conducted to the heat pipe and the vapor chamber, finally conducted to the reflection cup and the heat sink, and dispersed by a fin device of the heat sink via cross-ventilation and radiation, in which both the substrate and the heat pipe are heat conduction media with low thermal resistance.

2. The LED lighting fixture according to claim 1, wherein one side of the heat pipe facing to the heat sink is a plane or a cambered surface formed by pressing.

3. The LED lighting fixture according to claim 1, wherein the tail end of the heat pipe makes direct contact with the LED module; and one side of the tail end, making contact with the LED module, is a plane formed by pressing.

4. The LED lighting fixture according to claim 1, wherein an indent for receiving the heat pipe is formed on the outerwall of the reflection cup.

5. The LED lighting fixture according to claim 4, wherein one side of the heat pipe facing to the heat sink is a plane or a cambered surface formed by pressing.

6. The LED lighting fixture according to claim 1, wherein a groove for receiving the tail end of the heat pipe is formed on the supporting member.

7. The LED lighting fixture according to claim 6, wherein one side of the heat pipe facing to the heat sink is a plane or a cambered surface formed by pressing.

8. The LED lighting fixture according to claim 6, wherein the tail end of the heat pipe makes direct contact with the LED module; and one side of the tail end, making contact with the LED module, is a plane formed by pressing.

9. The LED lighting fixture according to claim 1, wherein a through hole is formed in the middle of the supporting member; and the LED module passes through the through hole and makes contact with the smoothing section of the vapor chamber.

10. The LED lighting fixture according to claim 1, wherein the cross section of each interposing section of the vapor chamber takes the shape of a circular arc which is cambered outwards, so that the two interposing sections are integrated into a circular arc with symmetrical notches; and correspondingly, the center hole section of the heat sink is provide with circular holes for interposing the two circular interposing sections respectively.

11. The LED lighting fixture according to claim 10, wherein transition sections retracted towards the center of a center shaft are arranged between the smoothing section and the two interposing sections of the vapor chamber; and a receiving cavity is formed at the front end of the center hole section of the heat sink and used for receiving and positioning the transition sections of the vapor chamber.

12. The LED lighting fixture according to claim 1, wherein the radiating sections adopt a fin-type structure formed by a plurality of radiating fins.

13. The LED lighting fixture according to claim 12, wherein a transition edge is connected between two adjacent radiating fins, so that an air channel with the chimney effect is formed between the two adjacent radiating fins.

* * * * *